United States Patent [19]

Cazaux

[11] 4,274,472

[45] Jun. 23, 1981

[54] CONTINUOUS CASTING INSTALLATION

[75] Inventor: Joel Cazaux, Chelles, France

[73] Assignee: Fives-Cail Babcock, Paris, France

[21] Appl. No.: 48,438

[22] Filed: Jun. 14, 1979

[30] Foreign Application Priority Data

Jun. 26, 1978 [FR] France ..... 78 18944

[51] Int. Cl.[3] ..... B22D 11/04

[52] U.S. Cl. ..... 164/416; 164/83

[58] Field of Search ..... 164/416, 83, 427

[56] References Cited

U.S. PATENT DOCUMENTS

| | | | |
|---|---|---|---|
| 3,258,815 | 7/1966 | Reinfeld et al. | 164/416 |
| 3,409,070 | 11/1968 | Ciochetto | 164/416 |
| 3,542,117 | 11/1970 | Lemper et al. | 164/416 X |
| 3,672,436 | 6/1972 | Wognum et al. | 164/416 |
| 3,779,303 | 12/1973 | Pietryka | 164/416 |

FOREIGN PATENT DOCUMENTS

| | | | |
|---|---|---|---|
| 1543075 | 9/1968 | France . | |
| 2294005 | 7/1976 | France . | |
| 51-81737 | 7/1976 | Japan | 164/416 |
| 447489 | 5/1968 | Switzerland | 164/416 |
| 973723 | 10/1964 | United Kingdom | 164/427 |

*Primary Examiner*—R. L. Spruill
*Assistant Examiner*—J. Reed Batten, Jr.
*Attorney, Agent, or Firm*—Kurt Kelman

[57] ABSTRACT

An installation for casting molten metal into a continuous strand from an oscillatory mold comprises a mold discharge guide rack including an assembly of guide elements for the continuous metal strand and two side supports for the guide elements. A mechanism for imparting oscillations to the mold includes a guide bar and a control lever operatively associated with the guide bar. Two fluidtight housings each affixed to a respective one of the side supports encloses the guide bar which is mounted in the housing on guide rollers assuring lateral and transverse guidance of the guide bar therein.

9 Claims, 2 Drawing Figures

CONTINUOUS CASTING INSTALLATION

The present invention relates to an installation for casting molten metal into a continuous strand, which comprises an oscillatory mold receiving the molten metal and discharging the continuous metal strand, a mold discharge guide rack including an assembly of guide elements for the continuous metal strand and two side supports for the guide elements, and means for imparting oscillations to the mold including means for guiding the oscillations and a control lever operatively associated with the guiding means.

U.S. patent application Ser. No. 914,440, filed June 12, 1978, which has been replaced by continuation-in-part application Ser. No. 75,975, filed Sept. 17, 1979, discloses a continuous casting installation of this general type wherein the mold discharge guide rack includes a succession of guide rollers whose ends are journaled in two side supports which are mounted on the support frame of the succeeding guide-roll rack section. The upper ends of the side supports carry guide and control means for the oscillation of the mold. The mold has no oscillating table and the mold discharge guide rack and the mold constitute a demountable and replaceable structural unit. In this installation, the oscillation guiding means of the mold are not protected against the abrasive action of dust, which shortens their operating life.

It is the primary object of this invention to overcome this disadvantage.

It is another object of the invention to provide an oscillation guide means which may be readily disconnected from the mold and/or the control lever for the oscillations. When disassembled from one or the other, it may form a unit with the mold or with the mold discharge guide rack.

The above and other objects are accomplished according to the present invention with two fluidtight housings each affixed to a respective one of the side supports of the mold discharge guide rack and enclosing the guiding means.

Figure 1:
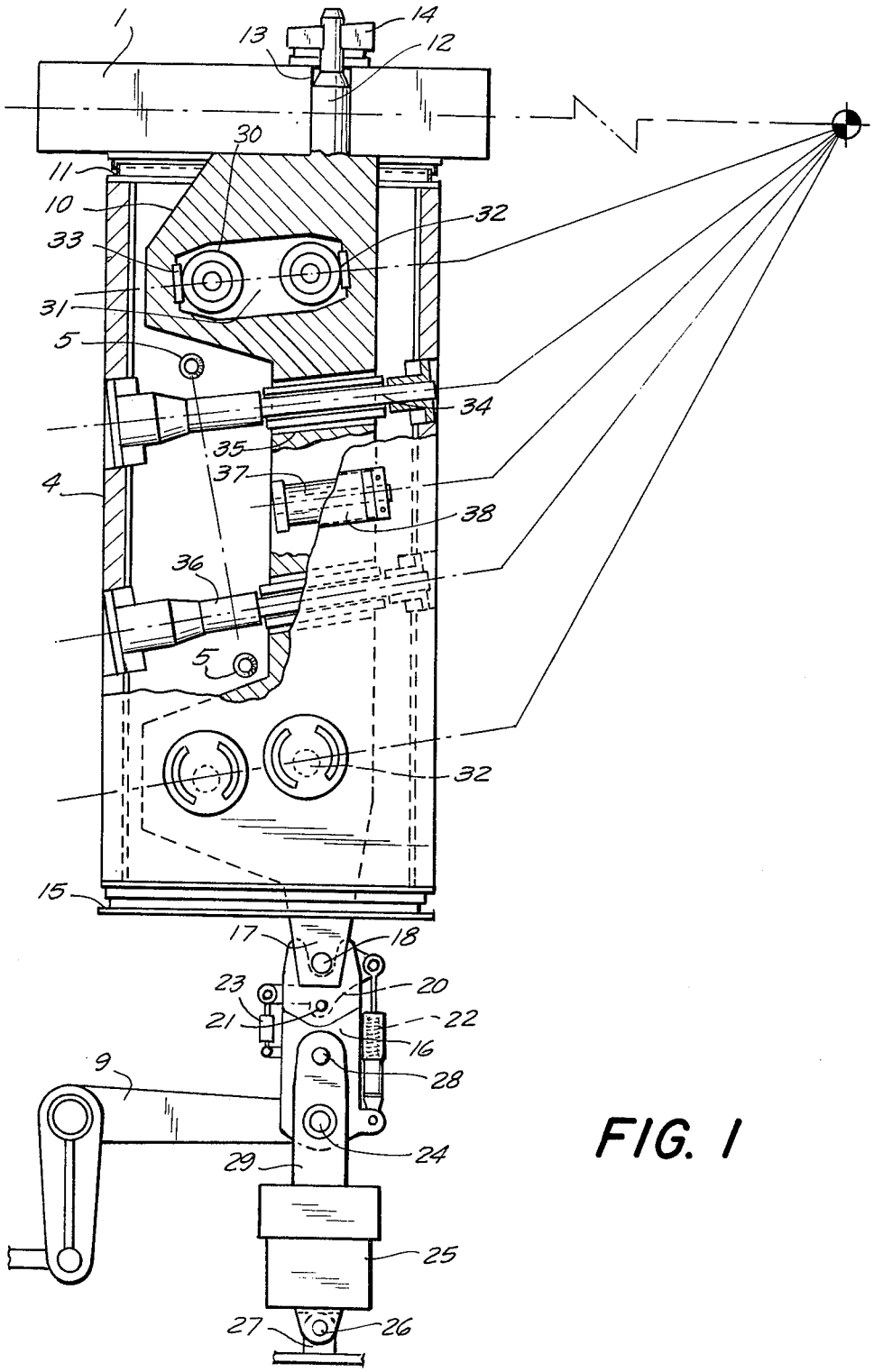
Figure 2:
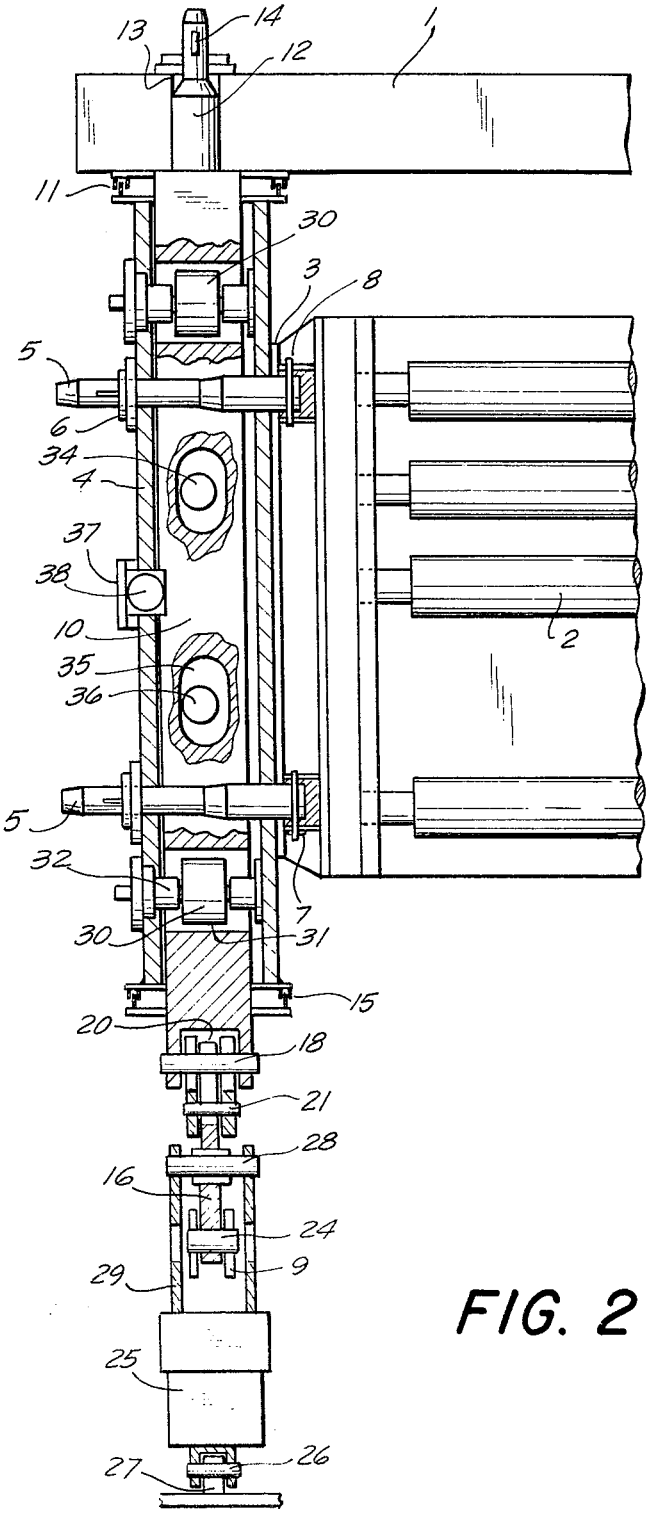

The above and other objects, advantages and features of this invention will be more fully understood from the following detailed description of a now preferred embodiment thereof, taken in conjunction with the accompanying drawing wherein FIG. 1 is a front view, partly in section, and FIG. 2 is a side view, also partly in section.

Referring now to the drawing, the installation for casting molten metal into a continuous strand may be of a generally well known type and only those parts of the installation essential for the invention have, therefore, been illustrated. It comprises oscillatory mold 1 of which only the frame has been shown and from which a continuous metal strand, for example a steel slab, is discharged by gravity. The continuous metal strand is received by a generally conventional mold discharge guide rack including an assembly of guide elements 2, such as rolls, for the continuous metal strand and two side supports 3 for the guide elements. Since the arrangement is symmetrical and the two sides are identical, only one side has been shown in FIG. 2. The installation according to the present invention comprises two fluidtight housings 4, each of the housings being affixed to a respective side support 3. In the illustrated embodiment, each housing 4 is affixed to the respective side support by two rods 5 passing through the housing and maintaining it in position. One end of each support rod is held in a respective bracket 8 affixed to side support 3, a bolt 7 passing through each support rod end and holding it in the bracket. Cotter pin 6 passes through a bore in the opposite end of each support rod to hold housing 4 in position between cotter pins 6 and side support 3.

The means for imparting oscillations to mold 1 includes means for guiding the oscillations enclosed in the housings 4 and control lever 9 operatively associated with the guiding means and disposed below housing 4 in the illustrated embodiment. The lever is entrained by a suitable mechanism (not shown).

Fluidtight housing 4 has an upper wall, a lower wall and two pairs of side walls therebetween, one pair of the side walls extending substantially parallel to side support 3 of the mold discharge guide rack and the other pair of the side walls extending perpendicularly thereto. The oscillation guiding means, in each housing 4, includes guide bar 10 having two ends. As appears in the front view of FIG. 1, the guide bar is generally U-shaped, extending with the two legs of the U in a plane substantially parallel to the side support. The ends of the guide bars fluidtightly pass respectively through the upper and lower housing walls, interlocking or labyrinth joints 11 and 15 being provided along the peripheries of the walls to assure a seal preventing dust from entering into the housing. The upper end of guide bar 10 is connected to mold 1, this end being constituted by connecting rod 12 journaled in shaft or guide bore 13 near an edge of mold 1. The rod is held in the bore by cotter pin 14 passing diametrically through the rod to affix the mold to the upper end of the guide bar. The lower end of guide bar 10 is connected to oscillation control lever 9 in the following manner:

Strut 16 is interposed between one of the ends of control lever 9 and the lower end of guide bar 10 to which transversely extending axle 18 is affixed. Connecting strut 16 has an upper fork-shaped part with two arms each defining notch 17, axle 18 being received in notches 17 of the two arms in stirrup fashion. Catch 20 is mounted on strut 16 by pivot 21 permitting the catch to be moved between a closing position for holding axle 18 in notches 17 and an opening position wherein the axle is released and may be moved out of the notches for detaching the guide bar from the control lever. Spring 22 is affixed to strut 16 and catch 20 and biases the catch into the closing position while jack 23 counteracts the spring bias when operated to move the catch into the opening position, the jack also being affixed to the strut and the catch.

Spring box 25 is mounted below and in alignment with connecting strut 16. The spring box has a base and an upper part. A fixed support 27 carries pivot 26 mounting spring box 25 for pivoting thereon, pivot 26 extending in a direction parallel to that of pivots 18, 21 and 24, pivot 24 connecting the one end of control lever 9 to connecting strut 16. The axes of these pivots extend perpendicularly to side support 3 of the mold discharge guide rack and fixed support 27 may be part of, or affixed to, the support frame of the succeeding guide-roll rack section of the installation (not shown). Arm 29 extends from the upper spring box part and axle 28, also parallel to pivots 18, 21 and 24, is affixed to strut 16 and spring box 25 is mounted on axles 26 and 28 for oscillating thereabout in a plane parallel to the side support of the mold discharge guide rack.

The means enclosed in housing 4 for guiding the oscillations of the mold laterally and transversely will now be described. This means includes guide rollers 30 arranged for lateral guidance of guide bar 10 in housing 4, the guide rollers being journaled with their axles 32 in the pair of housing side walls extending parallel to side support 3. The guide rollers are arranged in pairs, the guide bar defining cavities 31 passing through the bar legs and each pair of guide rollers being mounted in the respective cavity 31. The guide rollers of each pair are disposed in each cavity along a radius of curvature of the trajectory of oscillation in a circular arc. Each cavity 31 has two bearings 33 forming the race for the corresponding roller.

The guiding means further includes three guide rollers 34, 37 arranged for transverse guidance of guide bar 10 in housing 4, guide rollers 34 being journaled by their axles 36 in the pair of housing side walls extending perpendicularly to side support 3. The two guide rollers 34 are disposed in cavities 35 defined in the base of the U-shaped guide bar and the third transverse guide roller 37 is disposed between the two guide rollers 34 and cooperates with a face of guide bar 10. Cavities 35 extend perpendicularly to cavities 31, axles 32 of lateral guide rollers 30 extending perpendicualarly to axles 36 and 38 transverse guide rollers 34 and 37. As shown in FIG. 1, axle 38 of intermediate guide roller 37 is journaled in the front side wall of the housing extending parallel to side support 3 and extends in the same direction as axles 36. All three transverse guide rollers extend along respective radii of curvature of the trajectory of oscillation.

As will be readily understood from the above description of the structure, rocking of control lever 9 will oscillate guide bar 10 and mold 1 connected thereto and the lateral and transverse guidance of the bar will be assured by the guide rollers which mount the guide bar in housing 4, the guiding means being fully protected by the fluidtight housing. At the same time, guide bar 10 may be readily disconnected for the control lever simply by operating jack 23 to open catch 20 and permitting axle 18 to be removed from notches 17. It is thus possible simultaneously to remove mold 1 and housings 4 and mold discharge guide rack 2, 3 from the continuous strand being cast. If desired, only mold 1 may be removed by the simple detachment of cotter pin 14, which permits the mold to be lifted from connecting rods 12. Detachment of cotter pins 6 or bolts 7 similarly permits removal of housings 4 from the mold discharge guide rack.

While the oscillating arrangement has been described hereinabove in connection with an installation including an arcuate guide path for the continuous strand, it is equally applicable to an installation with a vertical guide path for the casting. In this case, the trajectory of the oscillations is rectilinear rather than curvilinear and the axles of the guide rollers will be oriented in relation to an imaginary arc of a circle of infinite radius and, therefore, a zero curvature. Thus, lateral guide rollers 30 of the same pair will be disposed at the same level while their axles 32 will extend horizontally.

Various structural modifications and variations will occur to those skilled in the art, particularly after benefitting from the present teaching, without departing from the spirit and scope of this invention as defined in the appended claims. For instance, a larger number of guide rollers than that described may be used. For instance, three pairs of lateral guide rollers may be provided and four or five transverse guide rollers. The latter guide rollers would then have to be so arranged that the odd-numbered guide rollers are mounted in cavities in the guide bar while the even-numbered guide rollers cooperate with a face of the guide bar. The shape of this guide bar would have to be changed accordingly.

Also, while mounting the guide rollers in cavities is particularly advantageous for protecting the guide rollers from any dust that may enter protective housing 4 despite the special joints designed to prevent such dust penetration into the housing, such mounting is not absolutely necessary. If desired, each lateral guide roller may cooperate with a lateral face of the guide bar and each transverse guide roller may cooperate with a face of the guide bar perpendicular thereto. While such a construction would be simpler, it would increase the volume of the protective housing.

Obviously, the guide elements of the mold discharge guide rack may not only be illustrated rolls 2 but may be guide plates or screens. All illustrated structural elements may be replaced by means functioning equivalents thereto.

I claim:

1. An installation for casting molten metal into a continuous strand, which comprises an oscillatory mold receiving the molten metal and discharging the continuous metal strand, a mold discharge guide rack including an assembly of guide elements for the continuous metal strand and means for supporting the guide elements, means for imparting oscillations to the mold, the oscillation imparting means including means for guiding the oscillations and a control lever operatively associated with the guiding means, and two fluidtight housings, the housings being affixed to the supporting means at respective sides of the guide rack and enclosing only the guiding means of the oscillation imparting means, each housing and enclosed guiding means constituting a structural unit.

2. An installation for casting molten metal into a continuous strand, which comprises an oscillatory mold receiving the molten metal and discharging the continuous metal strand, a mold discharge guide rack including an assembly of guide elements for the continuous metal strand and means for supporting the guide elements, means for imparting oscillations to the mold, the oscillation imparting means including means for guiding the oscillations and a control lever operatively associated with the guiding means, and two fluidtight housings, the housings being affixed to the supporting means at respective sides of the guide rack and enclosing the guiding means, each housing and enclosed guiding means constituting a structural unit wherein each housing has an upper wall, a lower wall and two pairs of opposite side walls therebetween, and the guiding means includes, in each housing, a guide bar having two ends, the guide bar ends fluidtightly passing respectively through the upper and lower housing walls, one of the guide bar ends being connected to the mold and the other guide bar end being connected to the control lever, and guide rollers arranged for lateral and transverse guidance of the guide bar in the housing, the guide rollers being journaled in the respective side walls.

3. The continuous casting installation of claim 2, wherein the lateral guide rollers are arranged in pairs, the guide rollers of each pair being disposed along a radius of curvature of the trajectory of oscillation, and the transverse guide rollers extending along respective ones of said radii.

4. The continuous casting installation of claim 3, wherein the guide bar defines respective cavities, each pair of the lateral guide rollers being disposed in one of the cavities.

5. The continuous casting installation of claim 3, wherein the guide bar defines two cavities and has a face, at least three of said transverse guide rollers being provided, two of the transverse guide rollers being disposed in the cavities and the third transverse guide roller being disposed between the first two transverse guide rollers and cooperating with the guide bar face.

6. The continuous casting installation of claim 2 or 3, wherein the guide bar end passing through the upper housing wall is connected to the mold and includes a connecting rod, the mold defining a shaft receiving the connecting rod, and means for affixing the connecting rod to the mold.

7. The continuous casting installation of claim 2 or 3, wherein the guide bar end passing through the lower housing wall is connected to the control lever, and further comprising a strut connecting the lower guide bar end to the control lever.

8. The continuous casting installation of claim 7, further comprising an axle affixed to the lower guide bar end, the connecting strut having an upper fork-shaped part with two arms each defining a notch, the axle being received in the notches of the two arms, a catch, a spring affixed to the strut and biasing the catch into a closing position for holding the axle in the notches, and a jack affixed to the strut for counteracting the spring bias and opening the catch.

9. The continuous casting installation of claim 8, further comprising a spring box having a base and an upper part, a fixed pivot mounting the spring box base for pivoting thereon, and an axle affixed to the strut and extending parallel to the pivot, the spring box being mounted on the axle for oscillating thereabout.

* * * * *